US009664066B2

(12) United States Patent
Deane et al.

(10) Patent No.: US 9,664,066 B2
(45) Date of Patent: May 30, 2017

(54) RETAINING CLIP AND METHODS FOR USE IN LIMITING RADIAL MOVEMENT BETWEEN SECTIONS OF A SPLIT FAIRING

(71) Applicant: General Electric Company, Schenectady, NY (US)

(72) Inventors: Eric Ryan Deane, Somerville, MA (US); Jason Walter Issertell, Stratham, MA (US)

(73) Assignee: General Electric Company, Schenectady, NY (US)

( * ) Notice: Subject to any disclaimer, the term of this patent is extended or adjusted under 35 U.S.C. 154(b) by 401 days.

(21) Appl. No.: 14/394,742

(22) PCT Filed: Apr. 26, 2013

(86) PCT No.: PCT/US2013/038433
§ 371 (c)(1),
(2) Date: Oct. 16, 2014

(87) PCT Pub. No.: WO2013/163554
PCT Pub. Date: Oct. 31, 2013

(65) Prior Publication Data

US 2015/0086355 A1 Mar. 26, 2015

Related U.S. Application Data

(60) Provisional application No. 61/639,607, filed on Apr. 27, 2012.

(51) Int. Cl.
*F01D 25/24* (2006.01)
*F01D 25/26* (2006.01)

(52) U.S. Cl.
CPC ..... *F01D 25/243* (2013.01); *F01D 25/246* (2013.01); *F01D 25/265* (2013.01); *Y10T 29/49229* (2015.01); *Y10T 403/1624* (2015.01)

(58) Field of Classification Search
CPC ..... F01D 25/24; F01D 25/162; F01D 25/243; F01D 25/246; F01D 25/265; F16B 2/20
See application file for complete search history.

(56) References Cited

U.S. PATENT DOCUMENTS 4,793,770 A 12/1988 Schonewald et al.
5,197,856 A * 3/1993 Koertge ..... F01D 25/246 415/199.4

(Continued)

FOREIGN PATENT DOCUMENTS

DE 1058794 B 6/1959
JP 6441621 A 2/1989

(Continued)

OTHER PUBLICATIONS

Unofficial English translation of Japanese Office Action issued in connection with corresponding JP Application No. 2015-509181 on Dec. 1, 2015.

(Continued)

*Primary Examiner* — Richard Edgar
(74) *Attorney, Agent, or Firm* — General Electric Company; William Scott Andes

(57) ABSTRACT

A retaining clip for use in limiting radial movement between a first section and a second section of a split fairing is provided. The first section includes a first clip tab and the second section includes a second clip tab extending therefrom, wherein the first and second clip tabs form a slot when the first section and the second section are substantially aligned. The retaining clip includes a first portion sized for insertion into the slot, a third portion coupled to the first and second clip tabs such that the first and second clip tabs are positioned between the first portion and the third portion, and a second portion extending between the first portion and the third portion.

20 Claims, 6 Drawing Sheets

(56) References Cited

U.S. PATENT DOCUMENTS

| | | | |
|---|---|---|---|
| 5,634,767 | A | 6/1997 | Dawson |
| 6,575,697 | B1 | 6/2003 | Arilla |
| 6,902,371 | B2 | 6/2005 | Anderson et al. |
| 8,096,755 | B2 | 1/2012 | Kammel et al. |
| 2002/0048512 | A1 | 4/2002 | Olivier Cot |
| 2007/0180828 | A1 | 8/2007 | Webb |
| 2010/0132374 | A1 | 6/2010 | Manteiga et al. |
| 2010/0135777 | A1 | 6/2010 | Manteiga |
| 2010/0275572 | A1 | 11/2010 | Durocher et al. |
| 2011/0081237 | A1 | 4/2011 | Durocher et al. |

FOREIGN PATENT DOCUMENTS

| | | | |
|---|---|---|---|
| JP | 2004060656 | A | 2/2004 |
| JP | 2008157251 | A | 7/2008 |
| JP | 2010127277 | A | 6/2010 |

OTHER PUBLICATIONS

Unofficial English translation of Chinese Office Action issued in connection with corresponding CN Application No. 201380022303.7 on May 28, 2015.

International Search Report and Written Opinion issued in connection with corresponding PCT Application PCT/US2013/038433 on Jul. 30, 2013.

* cited by examiner

RETAINING CLIP AND METHODS FOR USE IN LIMITING RADIAL MOVEMENT BETWEEN SECTIONS OF A SPLIT FAIRING

CROSS-REFERENCE TO RELATED APPLICATIONS

This application is a non-provisional application and claims priority to U.S. Provisional Patent Application Ser. No. 61/639,607 filed Apr. 27, 2012 for "A RETAINING CLIP FOR USE WITH A SPLIT FAIRING", which is hereby incorporated by reference in its entirety.

BACKGROUND OF THE INVENTION

The field of the invention relates generally to turbine assemblies and, more particularly to a retaining clip for aligning shroud overhang of a split turbine fairing.

At least some known gas turbine engines include a stationary turbine frame that includes a central hub, an outer ring surrounding the central hub, and a plurality of struts that extend radially between the hub and the outer ring. At least some known turbine frames are positioned within the turbine engine such that the frame is exposed to hot gas path fluid flow. As such, turbine frames are generally lined with temperature resistant materials for protection from hot gas path temperatures.

In at least some known turbine frames, the struts are protected from hot gas path temperatures with a fairing. In these known assemblies, non-destructive installation of the fairing onto the strut requires splitting the fairing into forward and aft sections. The forward and aft sections of these split fairings are positioned on opposite sides of the strut and coupled together to facilitate protecting the strut. At least some known split fairings use metallic buckles to couple forward and aft fairing sections together. Furthermore, as the size of known turbine frames increases, so does the circumferential distance between struts positioned radially about the central hub. As such, to prevent the addition of more fairings to compensate for the increased distance between adjacent struts, shroud overhang of the fairings is increased. However, increasing shroud overhang increases radial motion between forward and aft sections of the split fairing. As such, known metallic buckles are unable to compensate for the increased radial motion, which limits the size and length of shroud overhang that may be implemented.

BRIEF DESCRIPTION OF THE INVENTION

In one aspect, a retaining clip for use in limiting radial movement between a first section and a second section of a split fairing is provided. The first section includes a first clip tab and the second section includes a second clip tab extending therefrom, wherein the first and second clip tabs form a slot when the first section and the second section are substantially aligned. The retaining clip includes a first portion sized for insertion into the slot, a third portion coupled to the first and second clip tabs such that the first and second clip tabs are positioned between the first portion and the third portion, and a second portion extending between the first portion and the third portion.

In another aspect, a turbine frame is provided. The turbine frame includes a central hub, an outer ring surrounding said central hub, a strut extending between the central hub and the outer ring, and a split fairing positioned about the strut. The split fairing includes a first section including a first clip tab a second section including a second clip tab, wherein the first clip tab and the second clip tab form a slot when the first section and the second section are substantially aligned. The split fairing also includes a retaining clip including a first portion sized for insertion into the slot, a third portion coupled to the first clip tab and the second clip tab such that the first clip tab and the second clip tab are positioned between the first portion and the third portion, and a second portion extending between the first portion and the third portion.

In yet another aspect, a method of limiting radial movement between a first section and a second section of a split fairing is provided. The method includes forming a first clip tab on the first section, forming a second clip tab on the second section, coupling the first section to the second section around a strut such that the first clip tab and the second clip tab form a slot, and coupling a retaining clip to the first clip tab and the second clip tab.

DETAILED DESCRIPTION OF THE INVENTION

Embodiments of the present invention are directed to turbine assemblies and, more specifically to a retaining clip for facilitating reducing radial motion of shroud overhang of split fairings. Even more specifically, embodiments of the present invention are directed to a retaining clip coupled to forward and aft sections of a split fairing at a split line such that radial motion of shroud overhang is facilitated to be reduced. For example, the retaining clip described herein replaces one or more known metallic buckles that couple the forward and aft fairing sections together.

As such, in the exemplary embodiments, replacing one or more metallic buckles with a retaining clip facilitates enabling shroud overhang to be used in turbine engines of increasing size. In some known turbine assemblies, shroud overhang of forward and aft sections of a split fairing becomes separated from each other radially as the overhang length increases. Overhang length must be increased in turbine engines of larger size to enable the use of the same number of turbine frame struts. Increasing strut count and the presence of overhang separation is undesirable due to the creation of gas flow path blockage, which decreases engine performance.

Figure 1:
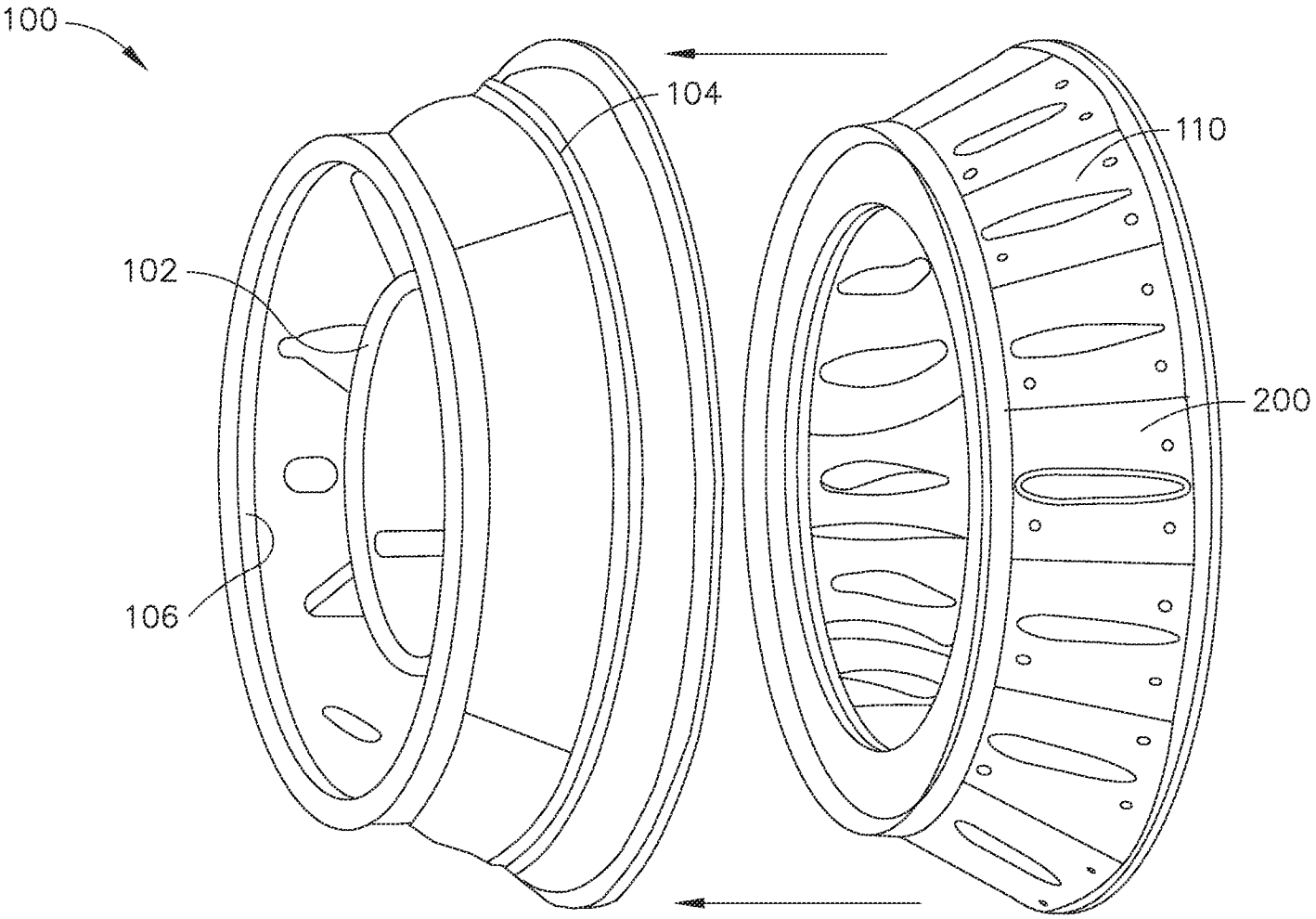
FIG. 1 is a perspective view of an exemplary turbine frame.

FIG. 1 is a perspective view of an exemplary turbine frame 100. Turbine frame 100 includes a central hub 102 and an outer ring 104 surrounding central hub 102. In the exemplary embodiment, central hub 102 and outer ring 104 are coupled together with struts 106 extending radially therebetween. Furthermore, in the exemplary embodiment, turbine frame 100 includes a plurality of service fairings 110 and a plurality of split fairings 200. Split fairings 200 are assembled around struts 106 such that struts 106 are substantially protected from a hot gas path environment.

Figure 2:
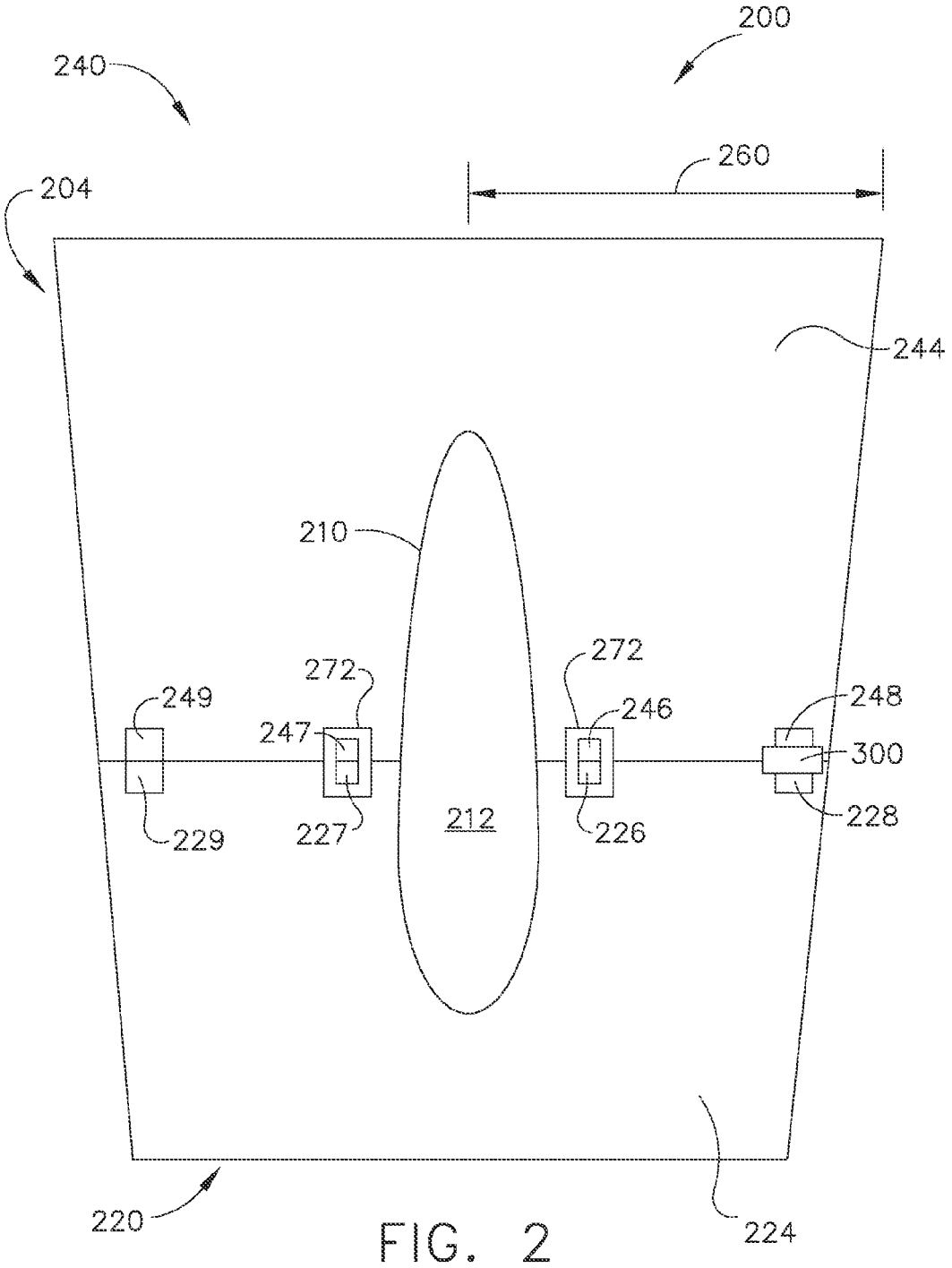
FIG. 2 is a top plan view of an exemplary split fairing shown in FIG. 1.
Figure 3:
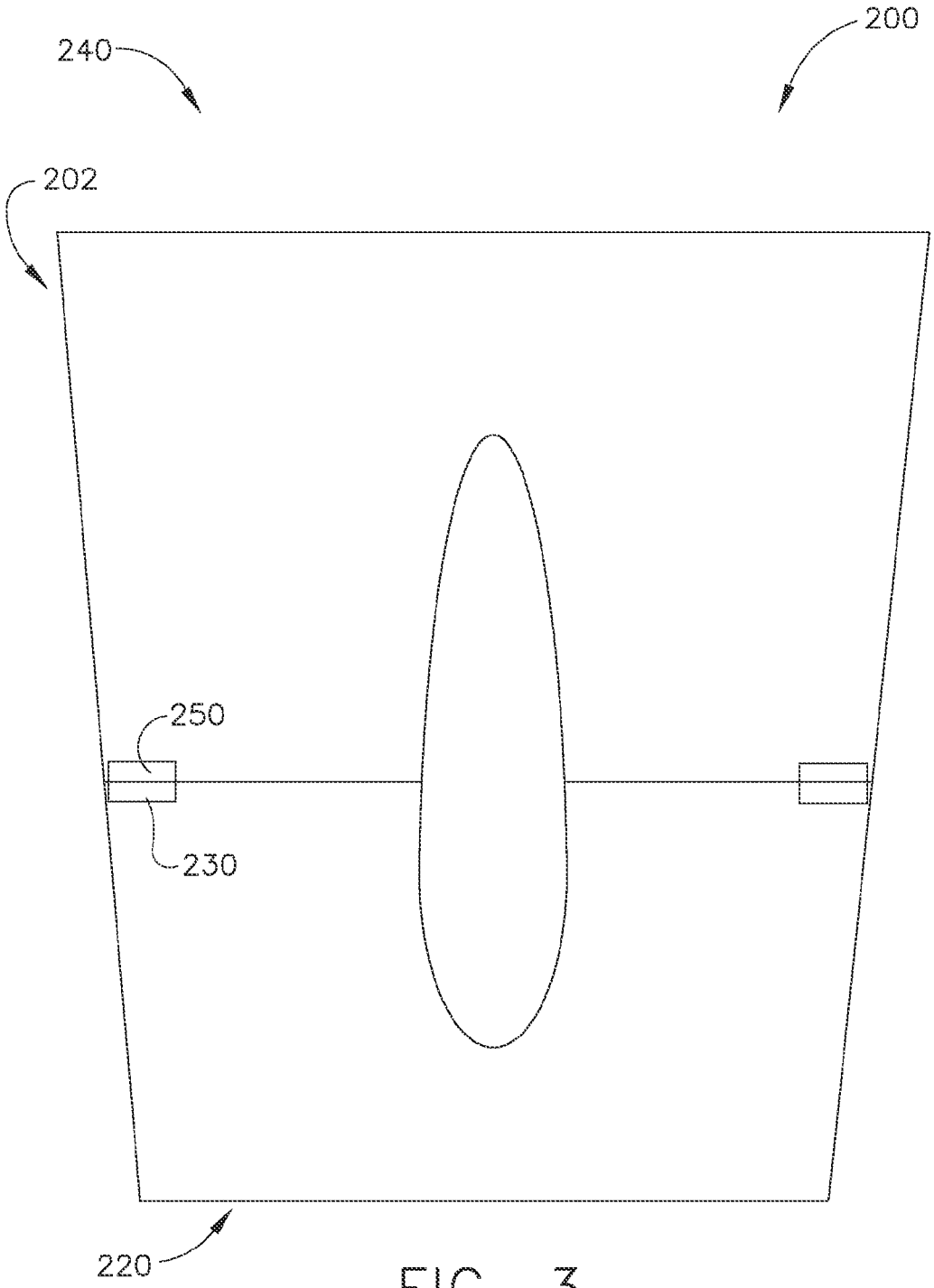
FIG. 3 is a bottom plan view of the split fairing shown in FIG. 2.

FIG. 2 is a top plan view of an exemplary split fairing 200, and FIG. 3 is a bottom plan view of an exemplary split fairing. In the exemplary embodiment, split fairing 200 includes a forward section 220 and an aft section 240. When coupled together, forward 220 and aft 240 sections are shaped to form an airfoil shaped vane 210. Airfoil shaped vane 210 is a hollow vane 212 that substantially conforms to the shape of struts 106 (shown in FIG. 1). As such, in the exemplary embodiment, forward 220 and aft 240 sections of split fairing 200 are positioned on opposing sides of struts 106 to facilitate protecting struts 106 from a hot gas path environment.

Furthermore, in the exemplary embodiment, split fairing 200 includes shroud overhang. More specifically, forward section 220 includes shroud overhang 224, and aft section 240 includes shroud overhang 244. Shroud overhang 224 and 244 extends from sections 220 and 240 to facilitate compensating for increased turbine frame 100 size. For example, in the exemplary embodiment, the length 260 of shroud overhang 224 and 244 is approximately one and a half inches from airfoil shaped vane 210. However, it should be understood that the length 260 of shroud overhang 224 and 244 is dependent upon the size of turbine frame 100 and the spacing of struts 106 positioned between central hub 102 and outer ring 104.

Furthermore, in the exemplary embodiment, forward section 220 includes a first buckle tab 226, a first clip tab 228, and a first mating flange 230, and aft section 240 includes a second buckle tab 246, a second clip tab 248, and a second mating flange 250. As such, when forward 220 and aft 240 sections of split fairing 200 are assembled, first buckle tab 226 substantially aligns with second buckle tab 246, first clip tab 228 substantially aligns with second clip tab 248, and first mating flange 230 substantially aligns with second mating flange 250. Furthermore, when forward 220 and aft 240 sections of split fairing 200 are assembled, a third buckle tab 227 substantially aligns with a fourth buckle tab 247, and a third clip tab 229 substantially aligns with a fourth clip tab 249. Although buckle tabs 226 and 246 and clip tabs 228 and 248 will be discussed in detail further, it should be understood that the same may apply to buckle tabs 227 and 247 and clip tabs 229 and 249.

In the exemplary embodiment, forward 220 and aft 240 sections are coupled together with a shear bolt (not shown), a buckle 272, and a retaining clip 300 (not shown in FIG. 2). For example, in the exemplary embodiment, each of first and second mating flanges 230 and 250 include a through bore (not shown) for receiving the shear bolt. The shear bolt facilitates maintaining radial alignment of sections 220 and 240 on a first side 202 of split fairing 200. In an alternative embodiment, retaining clip 300 may be used to maintain radial alignment in place of the shear bolt. Furthermore, in the exemplary embodiment, buckle 272 is sized to substantially conform to the combined shape of first and second buckle tabs 226 and 246. As such, buckle 272 facilitates maintaining axial coupling of forward section 220 to aft section 240 of split fairing 200.

Figure 4:
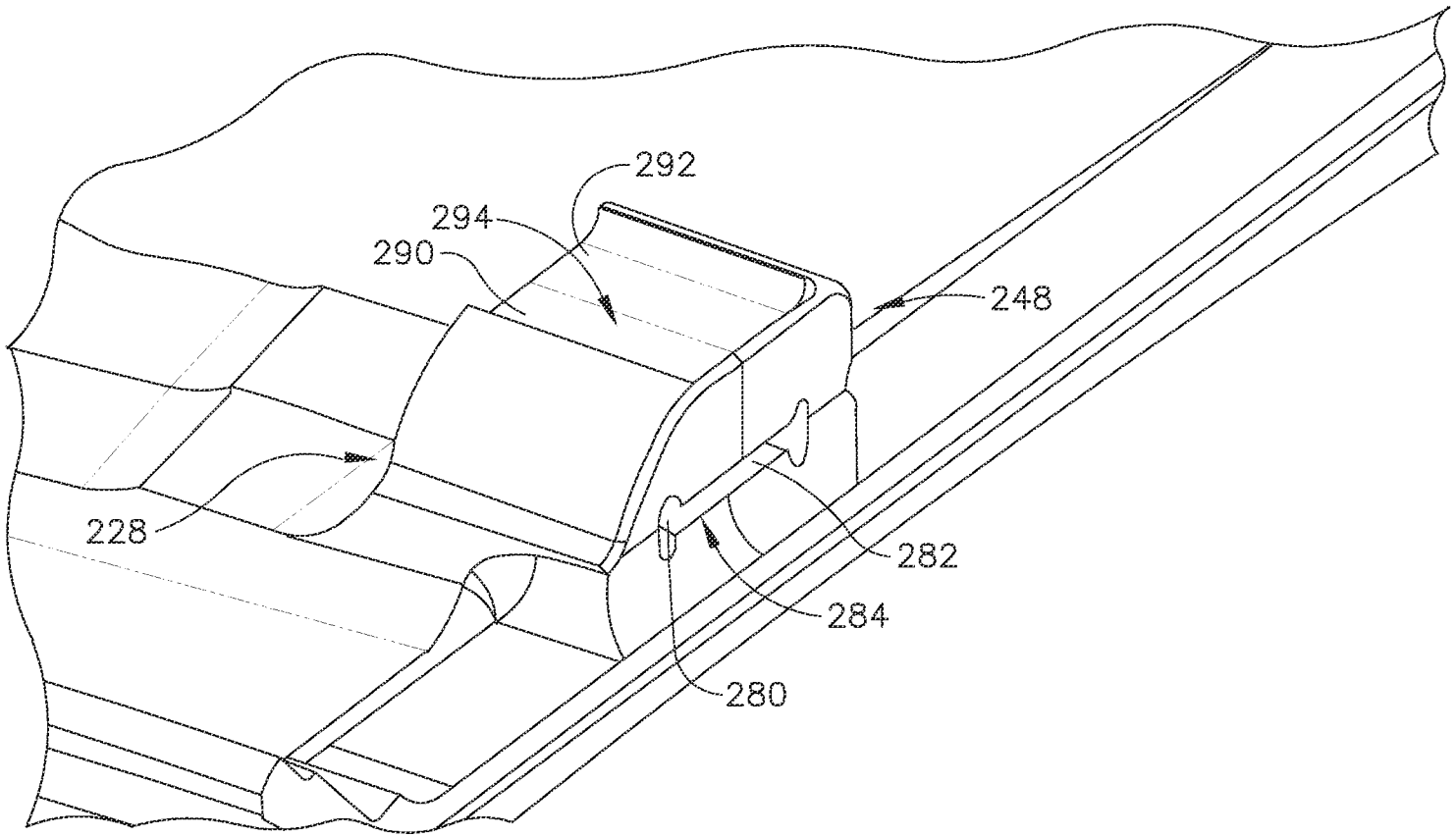
FIG. 4 is a close-up sectional view of exemplary retaining tabs shown in FIG. 2.

FIG. 4 is a close-up sectional view of exemplary clip tabs 228 and 248. In the exemplary embodiment, first clip tab 228 includes a first slit 280 and second clip tab includes a second slit 282. As such, when forward 220 and aft 240 sections of split fairing 200 are assembled, first and second slits 280 and 282 form a slot 284 for receiving a first portion 302 (not shown) of retaining clip 300. Furthermore, in the exemplary embodiment, first clip tab 228 includes a first indentation 290 and second clip tab 248 includes a second indentation 292. As such, when forward 220 and aft 240 sections of split fairing 200 are assembled, first and second indentations 290 and 292 form a notch 294 for receiving a third portion 310 (not shown) of retaining clip 300. In an alternative embodiment, clip tabs 228 and 248 may include a retaining tab defined within notch 294 to facilitate preventing retaining clip 300 from disengaging with notch 294. As such, retaining clip 300 facilitates maintaining radial alignment of fairing sections 220 and 240 on a second side 204 (shown in FIG. 2) of split fairing 200.

Figure 5:
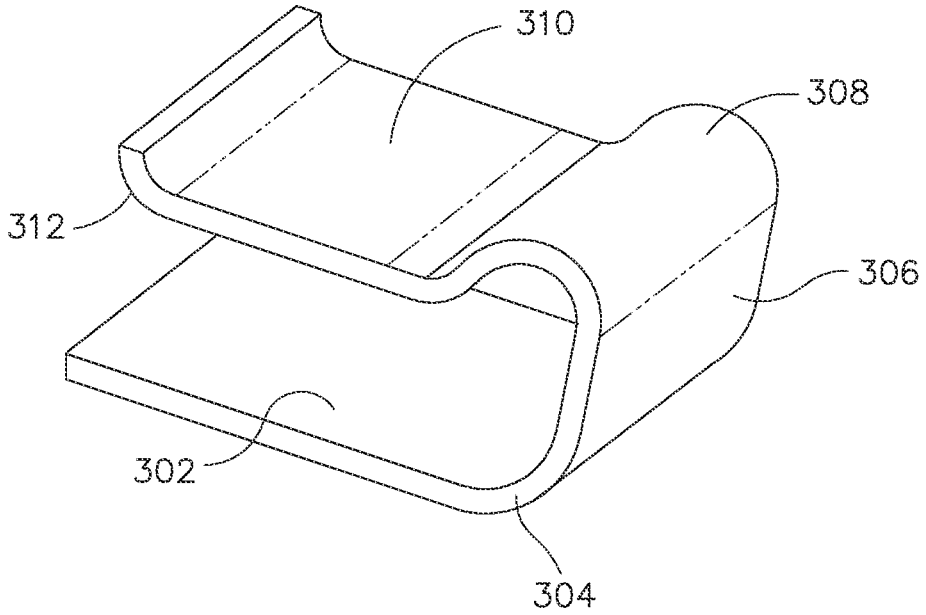
FIG. 5 is a perspective view of an exemplary retaining clip.

FIG. 5 is a perspective view of an exemplary retaining clip 300. In the exemplary embodiment, retaining clip 300 includes first portion 302, third portion 310, and a second portion 306 extending therebetween. More specifically, retaining clip includes, in series, first portion 302, a first bend 304, second portion 306, a second bend 308, third portion 310, and a third bend 312. As such, first portion 302 is substantially flat to facilitate insertion into slot 284 (shown in FIG. 4), and second bend 308 and third bend 312 facilitate configuring third portion 310 to substantially conform to the shape of notch 394. As such, when retaining clip 300 is engaged with first and second clip tabs 228 and 248, first and third portions 302 and 310 press against opposite sides of first and second clip tabs 228 and 248 to facilitate maintaining radial alignment of shroud overhang 224 and 244.

In the exemplary embodiment, retaining clip 300 is constructed of a nickel-based alloy such as R-41. However, it should be understood that retaining clip 300 may be constructed from any suitable material capable of withstanding a hot gas path environment of a turbine engine.

Figure 6:
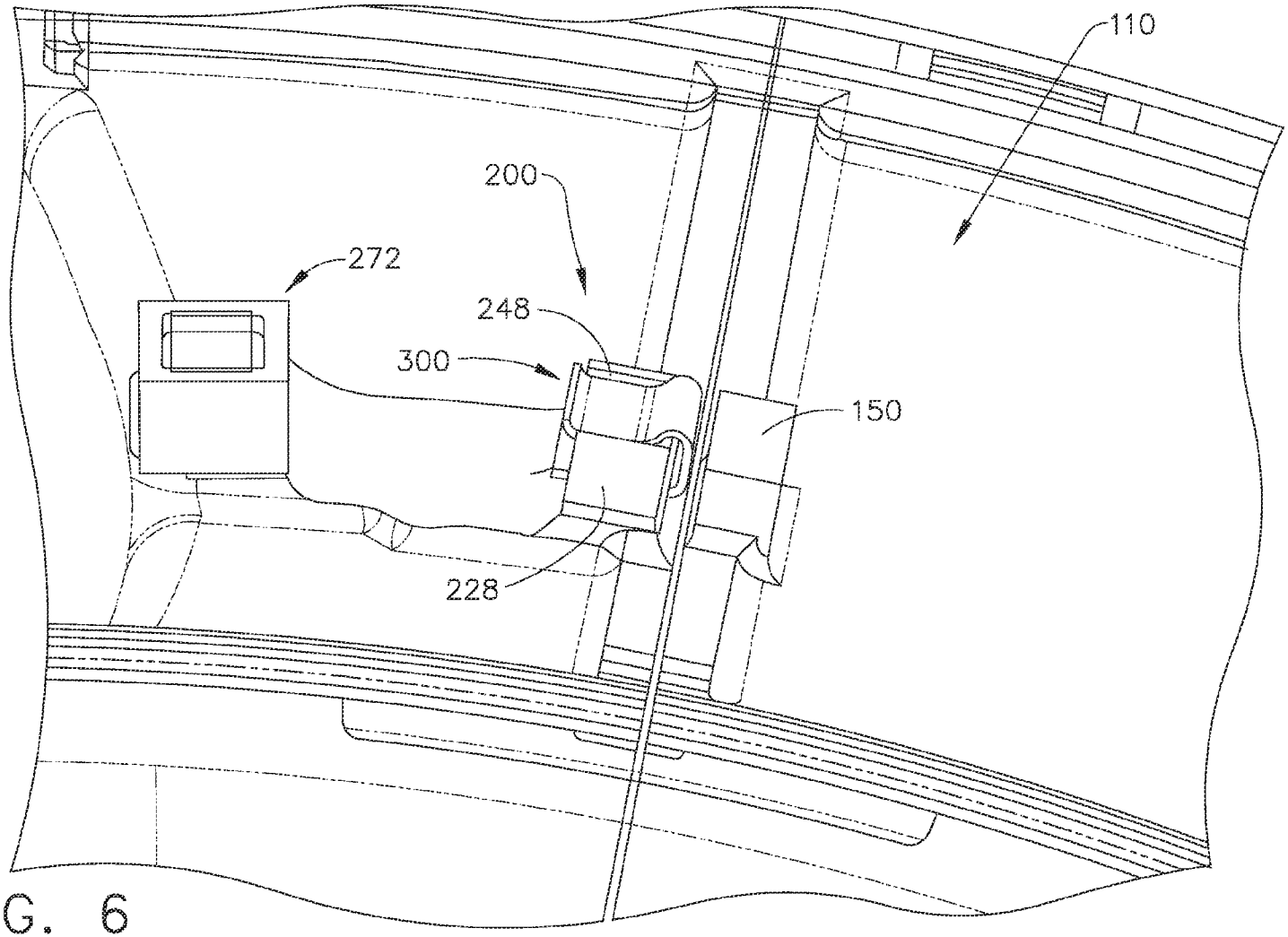
FIG. 6 is a close-up sectional view of the fairings shown in FIG. 1.

FIG. 6 is a close-up sectional view of exemplary fairings 200 and 110. In the exemplary embodiment, forward 220 and aft 240 sections of split fairing 200 are constructed around strut 106 (shown in FIG. 1). Buckle 272 is coupled to buckle tabs 226 and 246, and retaining clip 300 is engaged with clip tabs 228 and 248 such that forward section 220 is coupled to aft section 240. During operation, retaining clip 300 may disengage from clip tabs 228 and 248. As such, in the exemplary embodiment, service fairing 110 is installed within turbine frame 100 adjacent to split fairing 200. Service fairing 110 includes a retaining tab 150 substantially aligned with clip tabs 228 and 248 and second portion 306 of retaining clip 300. In the exemplary embodiment, retaining tab 150 is configured to press against second portion 306 of retaining clip 300 such that retaining clip 300 remains substantially stationary with respect to clip tabs 228 and 248.

The retaining clip described herein facilitates maintaining radial alignment of shroud overhang of adjacent sections of a split fairing. More specifically, the retaining clip is configured to extend at least partially along a length of a split line between adjacent sections of the split fairing. For example, the retaining clip replaces one or more known buckles that couple adjacent fairing sections together in an axial direction. Maintaining radial alignment of shroud overhang reduces blockage in the gas flow path of the turbine assembly. As such, as turbine engine size and shroud overhang increases, the retaining clip described herein facilitates increasing turbine efficiency by facilitating reducing blockage by shroud overhang in the gas flow path of the turbine assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A retaining clip for use in limiting radial movement between a first section and a second section of a split fairing, the first section including a first clip tab and the second section including a second clip tab extending therefrom, wherein the first and second clip tabs form a slot when the first section and the second section are substantially aligned, the retaining clip comprising:

a first portion sized for insertion into the slot;

a third portion coupled to the first and second clip tabs such that the first and second clip tabs are positioned between said first portion and said third portion; and a second portion extending between said first portion and said third portion.

2. The retaining clip in accordance with claim 1, wherein the retaining clip is fabricated from a metallic material.

3. The retaining clip in accordance with claim 1, wherein the retaining clip is fabricated from a nickel-based alloy material.

4. The retaining clip in accordance with claim 1, wherein said first portion, said second portion, and said third portion are formed from a continuous sheet of material including a first bend defined between said first portion and said second portion, and a second bend defined between said second portion and said third portion.

5. The retaining clip in accordance with claim 4, wherein said second bend facilitates defining a gap distance between said first portion and said third portion that is less than a length of said second portion.

6. The retaining clip in accordance with claim 1, wherein said first portion has a width that substantially extends along a length of the slot.

7. A turbine frame comprising:

a central hub;

an outer ring surrounding said central hub;

a strut extending between said central hub and said outer ring; and a split fairing positioned about said strut, said split fairing comprising:

a first section including a first clip tab;

a second section including a second clip tab, wherein said first clip tab and said second clip tab form a slot when said first section and said second section are substantially aligned; and a retaining clip including a first portion sized for insertion into said slot, a third portion coupled to said first clip tab and said second clip tab such that said first clip tab and said second clip tab are positioned between said first portion and said third portion, and a second portion extending between said first portion and said third portion.

8. The turbine frame in accordance with claim 7, wherein said first section and said second section each comprise a shroud overhang portion that extends circumferentially about said central hub.

9. The turbine frame in accordance with claim 8, wherein said first clip tab and said second clip tab are each formed on said shroud overhang portions of said first section and said second section.

10. The turbine frame in accordance with claim 8, wherein each said shroud overhang portion has a length of at least about 1.5 inches.

11. The turbine frame in accordance with claim 7, wherein said slot extends perpendicularly with respect to a split line defined between said first section and said second section of said split fairing.

12. The turbine frame in accordance with claim 7, wherein said first portion of said retaining clip has a width that extends beyond the split line when inserted into said slot.

13. The turbine frame in accordance with claim 7 further comprising a service fairing positioned adjacent to said split fairing, wherein said service fairing includes a retaining tab extending therefrom that substantially aligns with the retaining clip.

14. The turbine frame in accordance with claim 7, wherein a notch is formed on an outer surface of said first clip tab and said second clip tab when said first section and said second section are substantially aligned, wherein said notch is sized to receive said third portion.

15. A method of limiting radial movement between a first section and a second section of a split fairing, said method comprising:

forming a first clip tab on the first section;

forming a second clip tab on the second section;

coupling the first section to the second section around a strut such that the first clip tab and the second clip tab form a slot; and coupling a retaining clip to the first clip tab and the second clip tab.

16. The method in accordance with claim 15, wherein coupling a retaining clip comprises:

sizing a first portion of the retaining clip for insertion into the slot; and coupling a third portion of the retaining clip to the first clip tab and the second clip tab such that the first clip tab and the second clip tab are positioned between the first portion and the third portion.

17. The method in accordance with claim 16, wherein coupling a retaining clip comprises applying a compressive force to the first clip tab and the second clip tab from the first portion and the third portion of the retaining clip.

18. The method in accordance with claim 15 wherein coupling a retaining clip comprises:

positioning a service fairing adjacent to the split fairing, wherein the service fairing includes a retaining tab extending therefrom; and substantially aligning the retaining tab with the retaining clip.

19. The method in accordance with claim 18, wherein substantially aligning the retaining tab comprises substantially aligning the retaining tab with a closed end of the retaining tab defined by a second portion of the retaining tab.

20. The method in accordance with claim 15, wherein forming the first clip tab and forming the second clip tab further comprise forming each of the first clip tab and the second clip tab on shroud overhang portions of the first section and the second section.

* * * * *